US006099295A

United States Patent [19]

McCoy et al.

[11] Patent Number: 6,099,295

[45] Date of Patent: *Aug. 8, 2000

[54] POWER PHASE REGULATOR CIRCUIT IMPROVEMENT MOTOR START SWITCH SELF-ADJUSTING PREHEAT AND IGNITION TRIAL IMPROVEMENT AND SERIES-TYPE VOLTAGE REGULATOR IMPROVEMENT TO HOT SURFACE IGNITION CONTROLLER FOR FUEL OIL BURNER

[75] Inventors: Hugh W. McCoy; Gregory L. Sibalich, both of Bowling Green, Ky.

[73] Assignee: DESA International, Inc., Bowling Green, Ky.

[ * ] Notice: This patent is subject to a terminal disclaimer.

[21] Appl. No.: 09/262,170

[22] Filed: Mar. 3, 1999

Related U.S. Application Data

[63] Continuation of application No. 08/893,919, Jul. 11, 1997, Pat. No. 5,899,684.

[51] Int. Cl.[7] ..... F23N 5/08

[52] U.S. Cl. ..... 431/79; 431/66; 431/69; 431/78

[58] Field of Search ..... 431/66–69, 77–79, 431/6, 28, 44–46, 71–74, 24, 25

[56] References Cited

U.S. PATENT DOCUMENTS

| | | | |
|---|---|---|---|
| 3,393,039 | 7/1968 | Eldridge, Jr. et al. . | |
| 3,537,804 | 11/1970 | Walbridge | 431/66 |
| 3,651,327 | 3/1972 | Thomson | 250/217 F |
| 3,672,811 | 6/1972 | Hron | 431/69 |
| 3,713,766 | 1/1973 | Dunnelly et al. | 431/69 |
| 3,741,709 | 6/1973 | Clark | 431/79 |
| 5,470,223 | 11/1995 | McCoy | 431/24 |
| 5,567,144 | 10/1996 | McCoy | 431/79 |
| 5,899,684 | 5/1999 | McCoy et al. | 431/79 |

*Primary Examiner*—James C. Yeung
*Attorney, Agent, or Firm*—Jones, Day, Reavis & Pogue

[57] ABSTRACT

A fuel oil burner utilizing a hot surface ignition with an ignitor that is fully sintered and has essentially no porosity, a voltage phase regulator circuit for applying rectified half-wave AC line voltage, full-wave rectified AC, or either half-wave or full-wave rectified AC line voltage to the ignitor to supply power thereto, and AC line voltage to a blower motor, an AC-to-DC converter, a DC voltage preregulator, and a DC voltage regulator for providing twelve volts DC for operation of a control circuit that has a first time constant circuit for preheating the ignitor and maintaining the ignitor at consistent ignition temperature for a predetermined ignition trial time period and a second time constant circuit for driving second and third motor drive circuits. The third motor drive circuit energizes the start winding of the blower motor and the second motor drive circuit energizes the main winding of the blower motor thus starting the motor and providing fuel to the combustion chamber during a predetermined time concurrent with the ignition trial period. At that time, a third time constant circuit either maintains the fan blower motor in its energized state, if a flame of sufficient magnitude and frequency is detected, or de-energizes the blower motor, if the flame is not detected in less than one second after the ignitor is de-energized. A lock-up circuit is provided such that if no flame is detected, restart is accomplished only by first removing power and then reapplying power to the unit. The unit can be restarted in this manner even if there is a flame in the combustion chamber. Also, a shutdown circuit is provided if the flame detector shorts during burner operation.

19 Claims, 7 Drawing Sheets

CONTROL TIMING SEQUENCE POWER-UP WITH NO FLAME

CONTROL TIMING SEQUENCE FROM START-UP THROUGH FLAME-LOSS

POWER PHASE REGULATOR CIRCUIT IMPROVEMENT MOTOR START SWITCH SELF-ADJUSTING PREHEAT AND IGNITION TRIAL IMPROVEMENT AND SERIES-TYPE VOLTAGE REGULATOR IMPROVEMENT TO HOT SURFACE IGNITION CONTROLLER FOR FUEL OIL BURNER

This application is a continuation of Ser. No. 08/893,919, filed Jul. 11, 1997, now U.S. Pat. No. 5,899,684.

BACKGROUND OF THE INVENTION

1. Field of the Invention

The present invention relates to the control of fuel burning devices in general and in particular relates to a fuel oil burner operating with intermittent ignition and using a hot surface 120 volt ignitor electrode that is sintered to full density with no porosity and that will withstand applied voltages in excess of 230 volts AC for short duty cycles, a circuit for controlling the duty cycle, and a voltage phase regulator circuit to operate an 85 to 120 volt hot surface ignitor from a 180 to 254 volt AC source or operate a 60 volt hot surface ignitor from a 60 to 132 volt AC source and providing half wave consistent output voltage to the ignitor and that firer includes a trial ignition period during which time a blower motor of the spilt-phase type, and having a main winding and an auxiliary start winding, provides both air and fuel to the combustion chamber. If a flame is not detected in less than one second, the device is de-energized and starting must be retried.

In a second embodiment, a series-type voltage regulator circuit is used is to operate an 85 to 120 volt hot surface ignitor from a 180 to 254 volt AC source, to operate a 60 volt hot surface ignitor from a 60 to 132 volt AC source, or to operate an 85 volt hot surface ignitor from an 85 to 132 volt AC source and providing full wave consistent output voltage to the ignitor.

In the third embodiment of the present invention, a first circuit is provided that applies full-wave voltage to the ignitor only during the preheat and ignition trial periods for ignition purposes. A second circuit is provided that applies half-wave voltage to the ignitor continuously, beginning with the RUN period, for fast re-ignition and to burn any fuel coming in contact with the ignitor during the RUN period and thus prevents carbon buildup on the ignitor, especially if heavy fuels, such as diesel, are used. A third circuit is provided which automatically adjusts the preheat time and the ignition on-time, depending on the applied line voltage and the current draw of the ignitor.

2. Description of Related Art including Information Disclosed Under 37 CFR 1.97 and 1.98

Portable forced air kerosene heaters typically comprise an outer housing surrounding a combustion chamber. Air is forced into the combustion chamber. A burner is located at one end of the combustion chamber and the burner normally has a fuel nozzle frequently incorporating educator means providing jets of air to draw, mix, and atomize the fuel delivered by the nozzle. The nozzle, together with the educators, discharges a combustible fuel-air mixture into the combustion chamber. An ignitor is provided to ignite the mixture and, after initial ignition, continuous burning occurs. Typically, during the continuous combustion, forced air heat currents issue from the end of the heater opposite the burner and additional heat radiates from the surface of the heater housing.

Portable space heaters of the general type described are frequently provided with a direct spark type of ignitor and a motor. The motor normally runs a fan supplying air to the combustion chamber and the educators and operates a fuel pump or air compressor to supply the fuel to the combustion chamber.

When the portable space heater is functioning properly, fuel burning will occur near the end of the combustion chamber at which the burner is located. In the event of reduced air flow, however, the flame will move toward the opposite end of the combustion chamber, the oxygen supply becoming inadequate for proper combustion Under such a circumstance, it is desirable to shut down the heater. Inadequate air may result because of a malfunction of the fan or a blocking of the passages for air into or out of the combustion chamber.

It is also desirable to shut down the portable space heater when there is a flame failure. This can occur by virtue of faulty ignition, a blockage of the fuel nozzle, or exhaustion of the fuel supply.

Further, the prior art portable heaters utilize a spark gap for ignition. Some use heating coils that glow at a particular temperature sufficiently hot to cause ignition.

Hot surface ignition systems (HSI) have been used for more than twenty years for gas ignition in units such as gas clothes dryers, gas ovens, gas fired furnaces, and boilers thus replacing and eliminating standing gas pilot lights. Low voltage ignitors (12 and 24 volts) of the hot surface type are made from a patented ceramic/intermetailic material. These ignitors are used in compact low wattage assemblies for ignition of gas fuels. The element reaches ignition temperature in less than 10 to 15 seconds and utilizes about 40 watts of power. The ignitor is made from a composite of strong oxidation resistant ceramic and a refractory intermetallic. Thus hot surface ignitors have no flame or spark. They simply heat to the required temperature for igniting a fuel air mixture. Such ignitors have not been used in oil burning systems because the ignitor material is porous and oil entering the porous cavities causes buildup of the materials that are inimical to the operation of the burner.

A 120 V HSI ignitor has been developed in which the material is compressed and sintered to full density leaving no porosity resulting in a high performance ceramic composite. It can operate at very high temperatures such as 1,300 to 1,600 degrees Celsius. This same ignitor can withstand 230-volt operation at a reduced duty cycle to prevent overheating. The application of such high voltage hot surface ignition device is especially attractive for use in the present invention wherein fuel oil burning heaters are to be constructed. They provide unique advantages over prior art gas flames, heating coils, and spark gap ignition systems. However, the temperature of said hot surface ignitor varies with the applied voltage and some variation is found in normal response variations among the ignitors themselves.

This invention solves this problem by providing a circuit that responds to both current and voltage applied to the hot surface ignitor and is also used to operate a 120-volt ignitor directly on 230 volts or operate a 60-volt hot surface ignitor from a 60 to 132 volts AC source without a step-down transformer or series connected power dissipating devices.

In any case, malfunctions in the prior art heaters can cause insufficient or incomplete burning or a failure to burn issuing fuel thus producing a dangerous condition of highly flammable liquid or noxious fuimes. Prior art devices include a number of safety control circuits for fuel burning devices that are proposed to avoid the many and often undesirable results of improper burning or flame failure.

Thus, in U.S. Pat. No. 3,713,766 (Donnelly oil burner control 1973), a pretrial ignition period is determined by a bimetallic thermal switch which, after a predetermined period of time if ignition has not started, opens and removes the power to the heater.

Manual resetting of the bimetallic contacts is required to restart. However, during burner operation, if the flame for any reason goes out, a new trial period is automatically reinitiated. This could be dangerous if a fuel buildup in the combustion chamber is ignited. Further, if the photocell detecting the flame is shorted during operation, the burner will continue to operate because the circuit cannot detect that the photocell has been shorted and a shorted photocell condition is similar to the normal flame condition, which is a very low photocell resistance. The control will only detect a shorted photocell at start-up. Further, spark ignition is constantly applied during each cycle of the line voltage. Finally, there is an electric spark ignition circuit. Further, this control does not provide a motor start drive or preregulator or voltage regulator power supply circuits. In addition, this control does not provide current or voltage regulation to the ignitor.

In U.S. Pat. No. 3,651,327 (Thomson oil burner control 1972), a fluctuating control signal, due to flame fluctuation, is rectified and energizes a relay. This circuit is entirely a DC circuit. It responds only to the presence or absence of a flame and would require a separate circuit for a trial ignition period. It has no start-up circuit or restart circuit, no preheat circuit, and no hot surface ignition. Again, this control does not provide a motor start drive or preregulator or voltage regulator power supply circuits and, further, this control does not provide current or voltage regulation to the ignitor.

In U.S. Pat. No. 3,672,811 (Horon oil burner control 1972), if the photocell shorts during operation, there is no detection of loss of flame. Thus there is no shutdown of the fuel flow to the burner or the air blower. It also uses a spark gap ignition with a continuous spark being applied. There is no hot surface ignition and it does not provide a motor start drive or preregulator or voltage regulator power supply circuits. It also does not provide current or voltage regulation to the ignitor.

In U.S. Pat. No. 3,741,709 (Clark, commonly assigned), if the unit fails to start during an ignition trial period, a resistance heater opens the contacts of a thermal breaker unit to remove power. There is no shutdown of the control system if the photocell shorts. This control does not provide an ignition preheat period required for HSI ignition. This control does not provide an ignition preheat period required for HSI ignition. This control does not have the separate ignition control circuit for intermittent ignition. However, this control does contain moving parts. The timings of this control vary greatly with a change in applied voltage. There is no HSI ignition and, again, this control does not provide a motor start drive or preregulator or voltage regulator power supply circuits. This control also does not provide current or voltage regulation to the ignitor.

In U.S. Pat. No. 3,393,039 (Eldridge Jr. gas burner), if the unit fails to start during an ignition trial period, a resistance heater opens the contacts of a thermal breaker unit to remove power. It utilizes only AC voltage, uses a mechanical relay to cause continued operation of the circuit by detecting the heat of the flames, and has an automatic restart. It is not shut down during operation if the flame is gone. It simply keeps trying to ignite the fuel. Further, there is no hot surface ignition and the control does not provide a motor start drive or preregulator or voltage regulator power supply circuits, neither does it provide current or voltage regulation to the ignitor.

In U.S. Pat. No. 3,537,804 (Walbridge), an ignitor coil is used rather than a spark gap or pilot flame for ignition. The temperature of the ignitor coil is sensed by a photocell and, when the proper temperature is reached, the fuel valve is opened. It has a trial ignition in which, if a flame does not occur, a heating element opens bimetallic contacts to remove power. If the photocell is shorted during operation, the system simply tries to restart and does not shut down unless the heating element in the circuit reaches a predetermined temperature. Again, this device does not provide a motor start drive or preregulator or voltage regulator power supply circuits and neither does it provide current or voltage regulation to the ignitor.

SUMMARY OF THE INVENTION

The present invention relates to an improvement to commonly assigned U.S. Pat. No. 5,567,144 by Hugh W. McCoy entitled "HOT SURFACE IGNITION CONTROLLER FOR OIL BURNER" and incorporated herein by reference in its entirety. In the first embodiment, the present invention adds a 120 or 230 volt half-wave power regulator circuit that responds to both the ignitor current and voltage to operate a 60-volt ignitor on 120 volts half wave or to operate a 120-volt ignitor on 230 volts half wave, and includes a preregulator and regulator power supply circuits and adds a third switching circuit to power a motor auxiliary start winding. The invention also includes a fuel oil-type burner having a hot surface ignitor element that is manufactured to full density with no porosity. A blower provides air to the combustion chamber and an AC-to-DC half-wave converter circuit converts AC power to DC voltage output. A preregulator stores excess voltage for use during the undriven half cycle. A DC voltage regulator generates a DC output voltage of approximately 11 volts for operating a control circuit.

A first control switch is coupled between the AC power source and the hot surface ignitor electrode for selectively providing the half-wave AC power to the hot surface ignitor electrode. A second control switch is coupled between the AC power source and the blower for selectively driving the blower. A third control switch is coupled between the AC power source and the blower motor for driving the start, or auxiliary winding, for starting the split-phase type motor, which is used as the units increase in size.

A flame detector is associated with the combustion chamber for generating a signal if a flame is detected. A control assembly is coupled to the regulated DC output voltage and the flame detector for starting and maintaining the fuel oil burning by initiating an ignitor preheat period and an ignition trial period. The control assembly generates a first signal to the first control switch to couple the half-wave AC voltage to the hot surface ignitor to preheat the ignitor for a first predetermined period of time known as the ignitor preheat time period. It also provides heat for a second predetermined period of time known as the trial ignition time period. It further generates a second signal to the fan motor for introducing both air and fuel to the combustion chamber at the beginning of the trial ignition time period and for a very short period of time immediately following the trial ignition time period known as the flame test time period. It de-energizes the fan blower motor, which removes the fuel to the burner, if normal ignition does not occur during the flame test time period.

Thus the first embodiment of the present invention provides numerous advantages over the prior art. First, it uses a 120-volt hot surface ignitor element that can ignite oil without absorbing the oil and inhibiting the function of the hot surface ignitor. It also provides circuitry that provides the means for operation of a 60-volt ignitor directly on 120 volts or a 120-volt ignitor directly on 230 volts and further provides a constant temperature output over a wide input voltage.

Second, it provides half-wave AC to a 60-volt ignitor that provides for wide use of the heaters in areas where only 100 to 132 volts 50 or 60 hertz alternating current power is available or it provides a 230-volt half-wave AC to a 120-volt ignitor in areas where only 230 volts 50 or 60 hertz alternating current power is available. It also provides a circuit for maintaining virtually constant power output to the hot surface ignitor thus providing a consistent ignition temperature over a wide range of applied power line voltage. The circuit also provides AC drive to both the main and start windings of the blower and a well-regulated low voltage DC to the control circuits that can be formed of compact integrated circuits.

In the second embodiment, the operation is similar to the first embodiment except that the control assembly generates a first signal to the first control switch/voltage regulator to couple full-wave DC (converted from AC line voltage) to the hot surface ignitor to preheat the ignitor for a first predetermined period of time known as the ignitor preheat time. It also provides heat for a second period of time known as the trial ignition time period.

It provides a series voltage regulator which has a peak voltage at a predetermined level, around 75% of normal. By choosing an ignitor with this nominal operating voltage, a constant ignitor output temperature over a wide range of input voltage can be achieved.

In the third embodiment of the present invention, an ignitor current sampling feedback circuit is added that shortens both the preheat and ignition time period when the ignitor current reaches a predetermined level. The amount of shortening of the time periods is dependent upon the amount of ignitor current. This circuit also has a circuit to supply full-wave current to the ignitor during STARTUP and half-wave AC current, or pulsating DC current, to the ignitor during continuous RUN to minimize carbon buildup.

A control assembly incorporates an ignitor current-sensing circuit which automatically shortens the first and second predetermined time periods dependent on the ignitor current, thus shortening the preheat and the ignition trial periods.

Thus the third embodiment of the present invention provides numerous advantages over the prior art. First, it has a very simple electronic circuit that has a self-adjusting ignitor preheat time period, a self-adjusting ignition trial period, and a subsequent flame test in which, if no flame is apparent, the system shuts down by removing not only the voltage to the ignitor assembly but also to the fan blower assembly that stops the air and fuel from being provided to the combustion chamber.

It further provides a means of automatically adjusting the preheat and ignition trial tines to allow a wider range of voltage operation and a wider range of ignitor current tolerance variations and still provide adequate ignition temperatures. It also allows the use of high voltage AC applied directly to the ignitor and provides AC drive to both the main and start windings of the blower and a well-regulated low DC voltage to the control circuits that can be formed of compact integrated circuits.

Thus it is an object of the third embodiment of the present invention to operate the said ignitor from full-wave AC voltage during STARTUP and on half-wave voltage from a half-wave voltage phase regulator during normal RUN thus being capable of operating on one half the amplitude of the applied voltage.

It is another object of the present invention to provide voltage phase regulation to maintain constant ignition temperatures.

Thus the first embodiment of the present invention relates to a fuel oil burner including a fuel oil combustion chamber, a power source for providing a nominal voltage of at least 100 volts AC, a hot surface ignitor element associated with the combustion chamber, the ignitor electrode being sintered to full density with essentially no porosity, a current and voltage dependent ignitor power regulator circuit coupled to the power source for averaging the duty cycle of the voltage supplied to the hot surface ignitor, a fan blower driven by a split-phase type motor and having both a main and a start winding for providing fuel oil and air to the combustion chamber, an AC-to-DC converter coupled to the AC power supply for providing a DC voltage output, a preregulator circuit coupled between the AC/DC converter and the series voltage regulator circuit to provide output voltage during the negative going half cycle of the AC power supply to improve current capacity and low voltage operation, a voltage regulator circuit to provide a regulated low voltage DC voltage output, a first controllable switch coupled between the AC power source and the hot surface ignitor, a second controllable switch coupled between the AC power source and the main winding of said split-phase type of fan blower motor, a third controllable switch coupled between the AC power source and the auxiliary start winding of the split-phase type of fan blower motor, a flame detector associated with the combustion chamber for generating an electrical signal if a flame is detected, and a control assembly coupled to the voltage regulator circuit to receive the DC output voltage, the flame detector, and the first, second, and third controllable switches for heating the hot surface ignitor with the AC voltage for a first predetermined preheat time period, energizing a blower motor, and continuing to heat the hot surface ignitor during a second predetermined trial ignition time period.

The fan blower motor main winding is energized only at the beginning of the trial ignition time period and the start winding of said blower motor also is energized only at the beginning of the trial ignition time period. However, the start winding is de-energized at the beginning of the ignition test time period, which is activated at the end of the first time constant period. A short flame test time period immediately follows the trial ignition time period. If a flame appears but is insufficient to cause a photocell to produce an AC signal of proper amplitude and frequency, or if the flame disappears, the unit is shut down by removing fuel and air to the unit. The control then locks up preventing a restart from the photocell signal.

It is also an object of the second embodiment of the present invention to provide voltage regulation to maintain substantially constant ignition temperatures.

Thus the invention of the second embodiment, as in the first embodiment, relates to a fuel oil burner and further includes a first AC-to-DC converter coupled to the AC power supply for providing a predetermined full-wave output voltage, a second AC/DC converter coupled to the AC power supply for providing a half-wave pulsating DC voltage output for the control circuit, and a first controllable switch and combined voltage regulator coupled between the first AC/DC converter and the hot surface ignitor.

It is an object of the third embodiment of the present invention to provide a circuit similar to the first embodiment and adding to the electronic circuit a self-adjusting ignitor preheat time period and a self-adjusting ignition trial period to allow a wider range of voltage operation and a wider range of ignitor current tolerance variations and still provide adequate ignition temperatures.

It is also an object of the third embodiment of the present invention to provide full-wave AC voltage to the ignitor during STARTUP and half-wave DC voltage to the ignitor during RUN conditions to prolong the life of the ignitor.

Thus the third embodiment of the present invention is as the first and second embodiments and further includes a control assembly coupled to a voltage regulator, a flame detector, and first, second, and third controllable switches for heating the hot surface ignitor with the AC voltage for a first predetermined preheat period, which automatically shortens depending upon the ignitor current, energizing a blower motor and continuing to heat the hot surface ignitor during a second predetermined trial ignition period, which also shortens depending upon the ignitor current, the second controllable switch energizing the fan blower motor main winding only at the beginning of the trial ignition period, the third controllable switch energizing the start winding of the blower motor only at the beginning of the trial ignition period and de-energizing it at the beginning of the ignition test period, which is activated by the end of the first preheat period (the first time constant period). It also provides full-wave DC voltage for STARTUP and half-wave AC voltage for normal RUN conditions.

BRIEF DESCRIPTION OF THE DRAWINGS

These and other more detailed objects of the present invention will be more fully disclosed in the following DETAILED DESCRIPTION OF THE PREFERRED EMBODIMENTS in which like numerals represent like elements and in which.

DETAILED DESCRIPTION OF THE PREFERRED EMBODIMENTS

Figure 1:
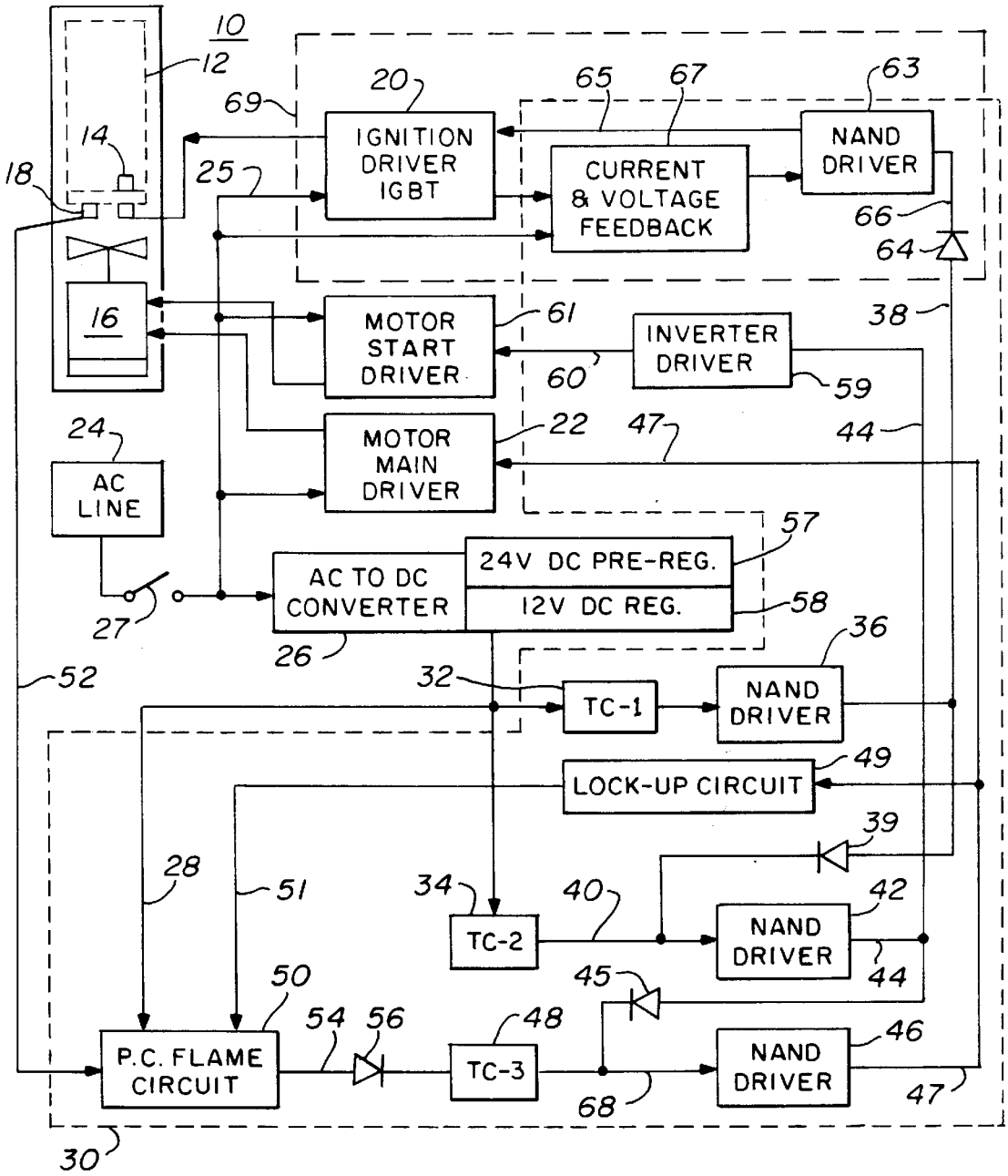
FIG. 1 is a schematic block diagram of the novel invention.
Figure 3:
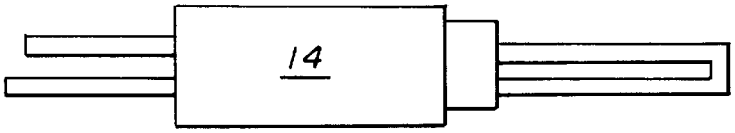
FIG. 3 is a schematic representation of a hot surface ignitor used in the present invention.

FIG. 1 is a schematic block diagram of the novel fuel oil-type burner 10 of the first embodiment illustrating the combustion chamber 12 in phantom lines in which is positioned a hot surface ignitor 14, a blower motor 16 that not only provides the air for the combustion chamber 12 but also provides the fuel oil, and a flame sensor or photocell 18. An ignitor power regulator circuit 69 includes an ignitor driver 20 that is coupled to the hot surface ignitor 14 to selectively couple AC line voltage of at least 100 VAC RMS from source 24 on line 25 through the AC/DC converter diode D7 and phase-type power regulator circuit 20 to the ignitor 14. In like manner, motor driver switches 22 and 61 selectively couple the alternating current voltage on line 25 to the blower motor 16 main and start windings to provide the fuel and air to the combustion chamber 12.

The AC voltage source 24 is also coupled through a switch 27 to a well-known AC-to-DC converter 26 that provides a half-wave DC output voltage signal to the preregulator 57. The preregulator 57 provides 24 volts maximum to the series regulator 58, and the series regulator 58 generates an output on line 28. Typically, the DC voltage on line 28 may be 11.25 volts.

Figure 4:
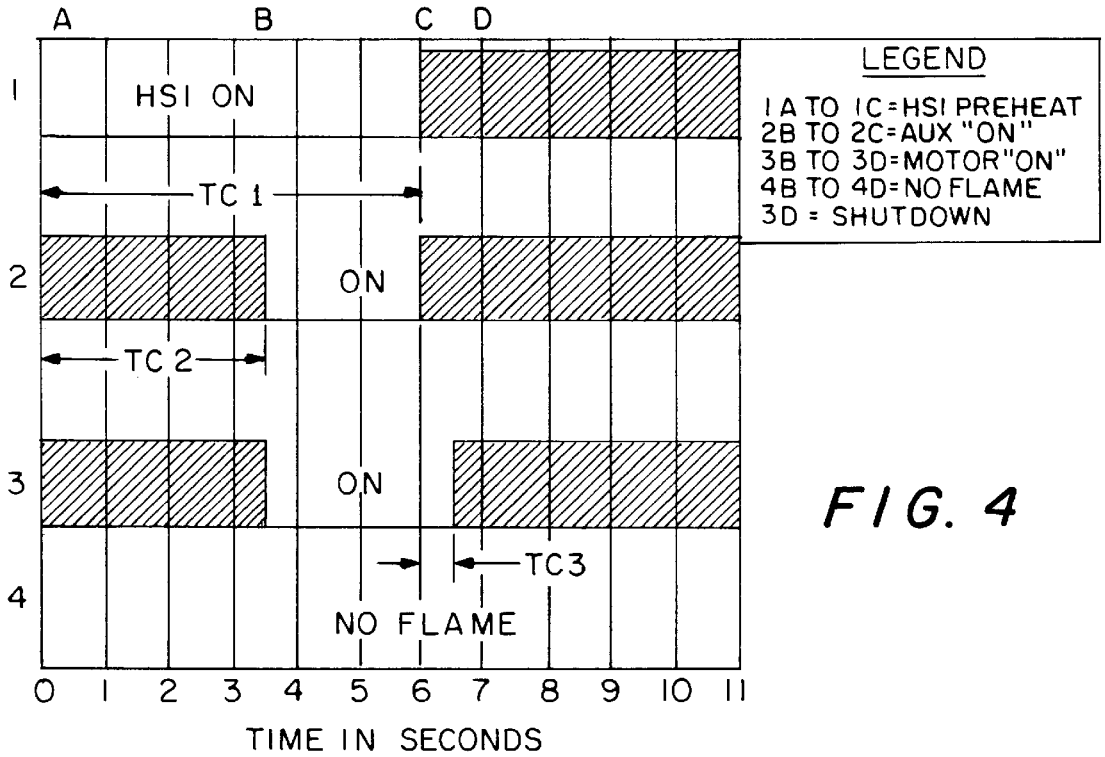
FIG. 4 is a timing table that shows control tidings from start-up to turn-off with "NO" flame detected.
Figure 5:
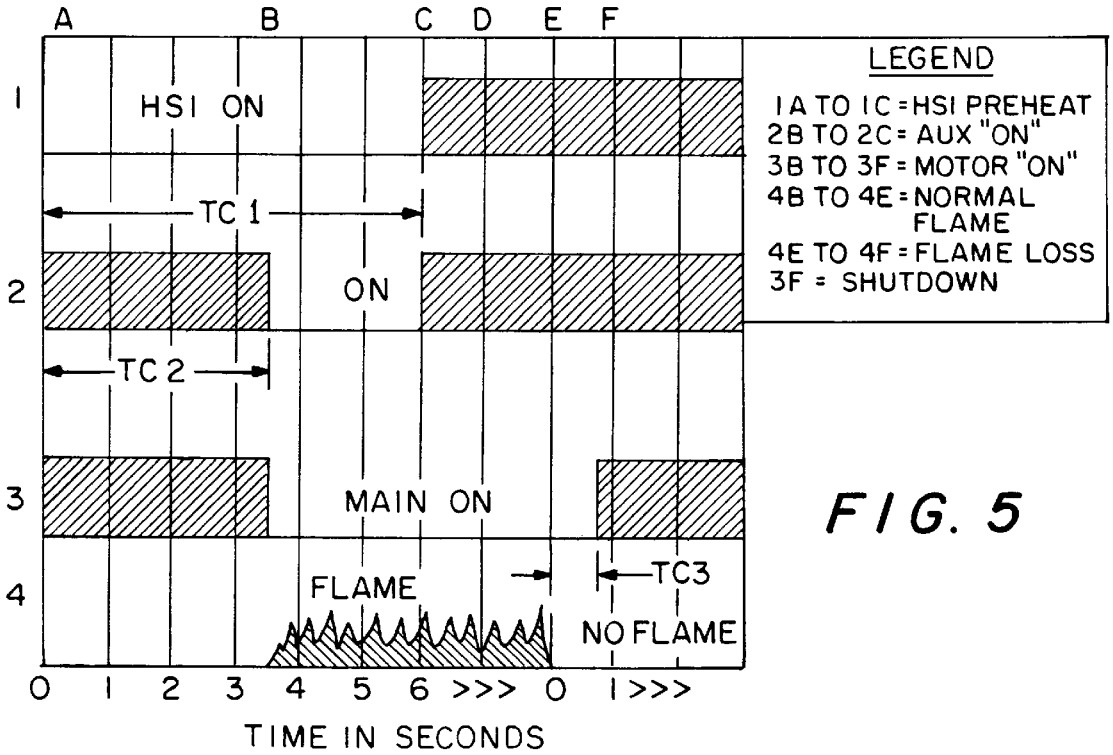
FIG. 5 is a table that shows control timings from start-up to normal flame to turn-off due to flame loss.

The description of controller circuit 30 will be made in conjunction with the timing charts shown in FIG. 4 and FIG. 5. FIG. 4 has the following labels: HSI PREHEAT=1A TO 1C, AUX "ON"=2B TO 2C, MOTOR "ON"=3B TO 3D, NO FLAME=4B TO 4D AND SHUTDOWN=3D. FIG. 5 has the following labels: HSI PREHEAT=1A TO 1C, AUX "ON"=2B TO 2C, MOTOR "ON"=3B TO 3F, NORMAL FLAME=4B TO 4E, FLAME LOSS=4E TO 4F, AND SHUTDOWN=3F.

When the switch 27 is closed and the voltage from source 24 is applied to the second AC/DC converter 26, which supplies DC voltage to the preregulator 57, the preregulator 57 limits the voltage at the input of the voltage regulator 58 to 24 volts. Voltage regulator 58 sets the DC voltage on line 28 and commences charging a first time constant circuit 32 and a second time constant circuit 34 in control assembly 30. For example, the first time constant circuit 32 may provide a time period of 6 seconds. This first time constant is represented as from 1A to 1C in FIGS. 4 and 5 and is labeled "TC1". Its output is coupled to NAND gate driver 36 whose logic low output on line 38 reverse biases diode 64, which allows the input of NAND gate 63 to generate a logic high output on line 65 that enables IGBT voltage regulator and ignitor driver 20. Driver 20 provides half-wave pulsating DC voltage output from the first AC/DC converter circuit diode D7 to the hot surface ignitor 14 to begin to heat it.

Time constant circuit TC1, represented by block 32, has a time period that lasts for approximately 6 seconds. This time period is shown in FIGS. 4 and 5 to be from 1A to 1C and is labeled "TC1". The first 3½ seconds of TC1 is a preheat period in which the ignitor 14 is brought to the proper temperature. This time period is shown in FIGS. 4 and 5 to be from 2A to 2B. At the same time the first time constant 32 (TC1) begins to function, the second time constant circuit, TC2, represented by block 34, begins to function. Its time constant period is approximately 3½ seconds and is coupled on line 40 to NAND gate 42. The second time constant circuit 34 initially causes no output on line 44, which is coupled through diode 45 to the input of NAND driver 46 and to a third time constant circuit, TC3, represented by block 48. The third time constant is shown in FIGS. 4 and 5 as being from 4C to 4D and is labeled as "TC3". When the 3½ second time constant period has expired, at point 2B, the ignitor 14 has reached the proper temperature for an ignition trial. This point in time is shown in FIGS. 4 and 5 to be point "B", which is the start of the "ignition trial period", and which extends from point "2B" to "2C". This is the same time period during which the start winding of the blower motor 16 is energized, as shown between points 2B and 2C and labeled as AUX "ON".

When the output of the second time constant circuit 34 on line 40 goes low, it causes a high output from NAND gate 42 on line 44 and through diode 45 to the third time constant 48 and to the input of NAND gate 46. This causes a low output from NAND driver 46 on line 47 to the motor main driver circuit 22 to enable it. This is the time period shown in FIGS. 4 and 5 at point 3B. Main drive circuit 22 couples the AC voltage on line 25 to the blower motor 16 main winding. At the same time, the logic high on line 44 is coupled to the input of inverter driver 59 causing a low on line 60, which is coupled to the motor start driver circuit 61, enabling it as shown in FIGS. 4 and 5 at point 2B. Drive circuit 61 couples the AC voltage on line 25 ta the motor start winding causing the motor 16 to start, and it commences to provide fuel oil and air to the combustion chamber 12. After the first time constant 32 expires, shown in FIGS. 4 and 5, at point "C", the output of NAND gate driver 36 on line 38 is coupled through diode 39 to the input of NAND gate driver 42 that forces a low output on line 44 to the input of inverter driver 59 and which causes a high output on line 60 disabling motor start driver 61 shown in FIGS. 4 and 5 at point 2C. The motor 16 continues to run due to power supplied by motor driver circuit 22 to the main winding, as can be seen at point 3C, in FIGS. 4 and 5. At the same time, this same LOW on line 44 couples through diode 45 to the third time constant 48 removing the logic high clamp to time constant 48, allowing it to discharge. The third time constant circuit, TC3, represented by block 48, and its time period shown between points "C" and "D" in FIG. 4 and labeled as "TC3", have a very short time constant period, for example, in the range from about 0.5 to 0.8 seconds. If in that time period no flame is detected, the third time constant circuit 48 discharges causing a high output to be produced by NAND driver 46 on line 47, which disables second switch or motor driver circuit 22 and removes the AC voltage 25 from the main winding of blower motor 16 thus stopping the operation of the system as shown at point 3D in FIG. 4 and labeled "SHUTDOWN". In such case, to attempt to restart, the switch 27 must be opened to initialize all circuits and then be closed to attempt to restart.

If, however, a flame has been detected by the photocell 18 and a proper flame signal is present on line 52, photocell flame control circuit 50 will provide intermittent pulses on line 54 through diode 56 to the third time constant circuit 48 to maintain its charged state thus providing the proper output signal from NAND driver 46 on line 47 to cause switch 22 to maintain the AC voltage applied to the blower motor 16, as shown in FIG. 5 between points 3B and 3F. If time constant circuit 48 does not receive an input from the photocell flame control circuit 50, as shown in FIG. 5 between points 4E and 4F, which is labeled "TC3" and is also known as the "flame test period", it will discharge in less than one second thus removing power to the blower motor 16, as shown in FIG. 5 at point "IF".

Thus the advantages obtained over the prior art, by using the circuit of FIG. 1 as described, is the use of AC line voltage-being applied to the ignitor, the blower motor main, and auxiliary (start) windings, all under direction from the control assembly 30. Also, the need for a separate motor start relay or posistor, normally used for starting split-phase motors, is eliminated. The problems associated with such motor starting devices are also eliminated. Also, ignitor power regulator circuit 69 is current and voltage dependent and acts as a first switch under the control of NAND driver 36 and is comprised of feedback 67, driver 63, diode 64, and driver 20 and provides consistent ignitor output temperatures to insure ignition even at extremely low temperatures over a wide range of AC line voltages and the normal tolerance range of ignitors by averaging the duty cycle of the voltage supplied to the hot surface ignitor 14, as will be explained hereafter.

The series low voltage regulator 58 along with the preregulator 57 assures improved operation at lower AC line voltages, by having less voltage variations of the output of the low voltage DC supply, which results in more consistent control things from time constants TC1, TC2, and TC3.

The first time constant circuit 32 causes the hot surface ignitor 14 to be preheated under the control of NAND driver 36 and, at the end of the preheat period, the second time constant circuit 34 and NAND driver 42 turns ON both the main and start windings of the blower motor 16, at time point "B", in FIGS. 4 and 5 and provides fuel and air. At the end of the ignition trial period, at time point "C", the first time constant circuit 32 generates a logic high output through diode 39 and NAND gate 42 removes the logic high on line 44 that both turns OFF start driver 61 (a second switch) to the start winding of blower motor 16 and also removes the logic high that was coupled through diode 45 to time constant 48. The third time constant 48 is allowed to discharge. It starts at point "C" and ends at point "E" as seen in FIG. 4. Turn OFF occurs at point "D" if a flame has not been detected, but is delayed indefinitely to point "E" if a flame has been detected as seen in FIG. 5. The third time constant circuit 48 discharges within the less-than-one-second time period, TC3, and the output of driver 46 on line 47 opens a third switch 22 and removes the power to the blower motor 16. This less-than-one-second discharge time, TC3, of the third time constant 48 is called a flame test period.

Figure 2:
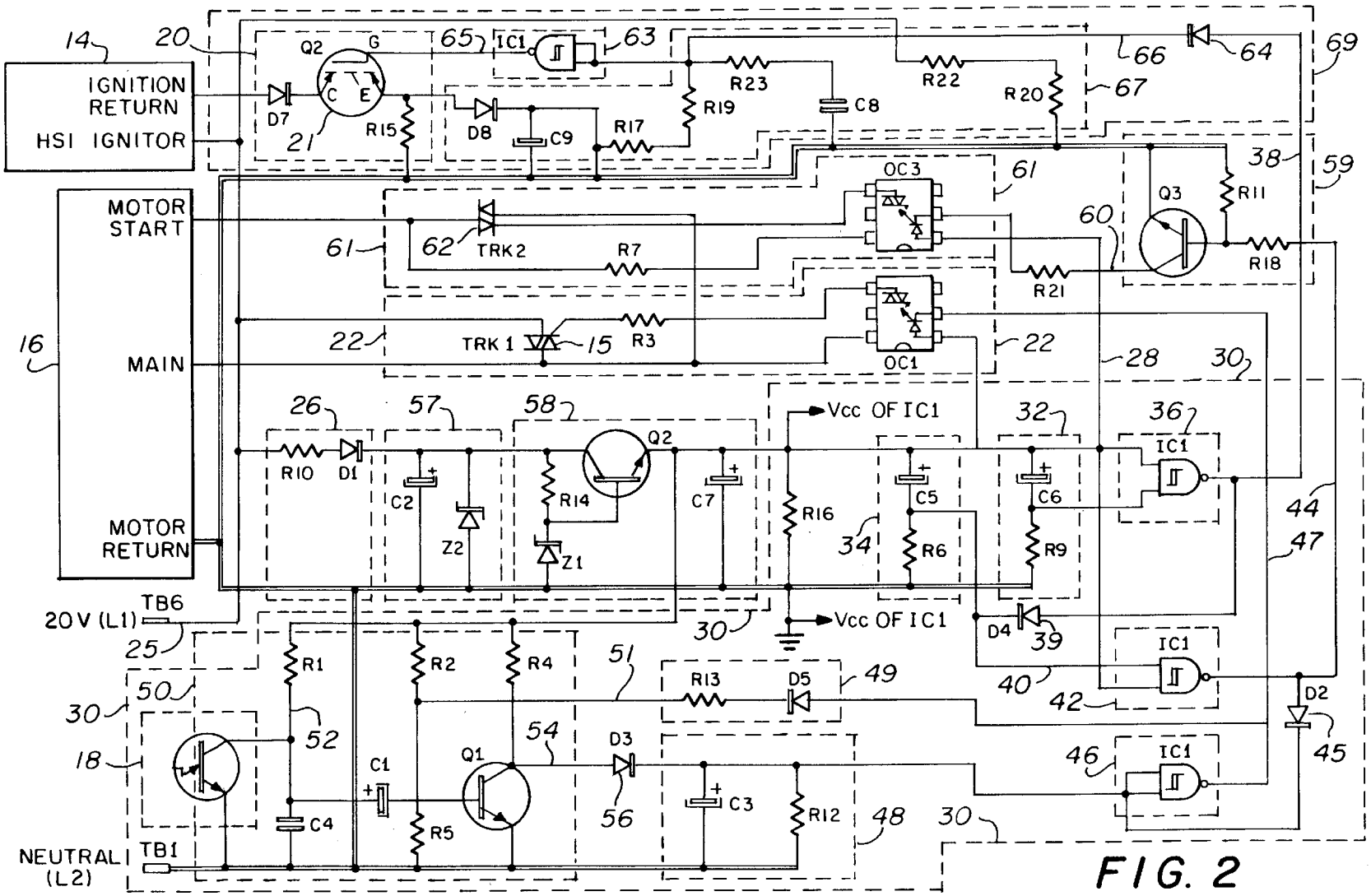
FIG. 2 is a corresponding circuit diagram of a first embodiment of the invention.

Further, the photocell flame control circuit 50 functions in a unique manner, as will be seen hereafter in relation to FIG. 2. Finally, when the "no flame" condition is detected by the third time constant 48, the output signal from driver 46 on line 47, that removes power to the blower motor 16, as previously described, is also coupled through a lock-up circuit 49 on line 51 to the photocell flame control circuit 50 to disable it so that it cannot be used to provide a false signal to the third time constant to maintain the operation of the fan blower motor 16 and perhaps cause accidental injury to service persons due to accidental restart of fan blower motor 16.

FIG. 2 discloses the details of the block diagrams of FIG. 1 and is a complete circuit diagram of the present invention.

As can be seen in FIG. 2, during power-up, when switch 27 (FIG. 1) is closed, the AC line voltage at source 24 (FIG. 1) is coupled on line 25 through the ignition driver 21 and the rectifier D7. Line 25 also is coupled to the motor driver 22 and the AC-to-DC converter 26, that couples a DC output voltage signal to the preregulator 57. The preregulator 57 couples 24 volts maximum to the series regulator 58, and the series regulator 58 generates an output on line 28. Typically, the DC voltage maybe 11.25 volts on line 28.

When the switch 27 (FIG. 1) is closed and the voltage from AC source 24 is applied to the second AC/DC converter 26, DC voltage is supplied to the preregulator 57 and charges C2. The preregulator 57 limits the voltage at the input of the voltage regulator 58 to 24 volts, which is stored in capacitor C2. Resistor R14 supplies voltage to the 12 volt reference voltage zener diode, Z1, and to the base of the voltage regulator transistor, Q2, which sets the DC voltage to approximately 11.25 volts on line 28.

As soon as the CMOS logic threshold is reached, the first time constant circuit 32 and the second time constant circuit 34 begin to charge. The junction of capacitor C6 and resistor R9 in the first time constant circuit 32 is coupled as an input to NAND gate driver 36. The other input is at 11.25 VDC. This causes the output on line 38 to go essentially to ground potential. This ground potential on line 38 is coupled to the anode of diode 64 that reverse biases diode 64 and negates any effect it would have on a positive going voltage on line 66 that is coupled to both inputs of NAND gate 63. NAND gate 63 inputs are now influenced only by the current and voltage feedback circuit 67. This enables the ignitor driver circuit 20 to operate in the following manner.

During the negative going half cycle, initially the inputs of NAND gate 63 are slightly negative due to the drive from voltage divider circuit R22 and R20 through R23. The output on line 65 is at logic high, which biases ON ignition driver IGBT 21 but diode D7 is reverse biased and no current flows from line 25 through ignitor 14. When the power line voltage swings positive, diode D7 is now biased ON and current flows from line 25 through ignitor 14, diode D7, ignition driver IGBT 21, and current sensing resistor R15 to neutral or ground. The voltage at the junction of divider R22 and R20 swings positive, reversing the charge on capacitor C8, which is coupled through R23 to line 66 as an input to NAND gate 63. At the same time, the voltage drop across the current sampling resistor R15 begins to charge the time constant circuit (capacitor C9 and R17) through diode D8 that is also coupled to line 66 through R19 and that also increases the voltage at input of NAND gate 63. When the positive going voltage of the power line increases to a predetermined level the voltage input to NAND gate 63 reaches the logic level and switches the ignition driver IGBT 21 OFF, which turns off the ignitor. The value of capacitor C8 is just large enough to hold the voltage of the AND gate 63 input above the logic threshold and prevent switching the NAND gate 63 while the line voltage is reducing from maximum positive peak value to zero volts but small enough to discharge during the negative half cycle thus again applying a logic low to the input of NAND gate 63 and switching its output on line 65 to logic high so IGBT 21 is turned ON at the start of the next positive going half cycle. Capacitor C9 is large enough to hold a charge for a much longer time period and its voltage is proportional to the short term average of the current through the ignitor 14 (the charge on C9 is eventually bled off by resistor R17). Thus, the turn-off point of the ignitor 14 is determined both by the positive going line voltage and the amount of current through the ignitor 14. Therefore, the current and voltage dependent ignitor power regulator circuit 67 is a half-wave voltage phase regulator that averages the duty cycle of the voltage supplied to the hot surface ignitor 14. With proper selection of component values, a near constant power will be provided to drive ignitor 14. Also, if a low tolerance ignitor is used, the lower average current will cause the NAND gate 63 to switch OFF IGBT 21 at a higher line voltage level thus boosting the power applied to the ignitor and bringing the ignition temperature up to the normal value. Also, line voltage dips when the blower motor 16 is energized and blows air over the ignitor, which tends to cool it down some. The power regulator circuit 67 will keep the ignitor energized, at its nominal operating power, under reduced line voltage thus helping to maintain a constant temperature output from the ignitor 14. As described above, half-wave AC line voltage is applied to the ignitor 14 and begins the preheat stage of operation at time point "A" in FIGS. 4 and 5.

At the same time, the second time constant circuit 34 starts with 11.25 volts or a logic high at the junction of C5 and R6 on line 40. This logic high on line 40 is coupled as one input to the second NAND gate 42. Again, the other input is also at 11.25 VDC. This causes a low output from NAND gate 42 on line 44. Diode 45 is reversed biased and does not influence the input to the third NAND gate 46 or the time constant circuit 48. Also it is to be noted that initially there is no flame in the chamber 12 and thus no signal from photocell 18 so input circuit 50 does not charge time constant 48.

Because this is a low input to NAND gate 46 on line 45, when the second time constant circuit 34 first starts to decay, a high output is developed on line 47 from NAND gate 46 and coupled to motor driver circuit 22. A high output cannot enable circuit 22 since a ground is required. However, when the voltage from the second time constant 34 has decreased to the CMOS level of its logic threshold, the second NAND gate 42 produces a high output on line 44 that is coupled through diode 45 as a high input to third NAND gate 46. This causes a low output on line 47 to the motor driver circuit 22. It activates the optical circuit 17 that provides a gate voltage to triac 15 that conducts and couples the AC line voltage on line 25 to the fan blower motor main winding, as shown at point 3B in FIGS. 4 and 5. At the same time the logic high on line 44 is coupled to the input of the inverter driver 59, causing a logic low on output line 60. It activates the optical circuit 19 of motor start driver 61 that provides a gate voltage to triac 62 that conducts and couples the AC line voltage from triac 15 to the fan blower motor start winding to activate the fan blower motor 16, as shown at point 2B in FIGS. 4 and 5. Motor 16 starts, causing fuel and air to be provided to the combustion chamber.

At the same time that the high output from the second NAND gate 42 on line 44 through diode 45 is energizing the third gate 46 and driver 59 to start the fan blower motor, it is also charging third time constant circuit 48 containing parallel capacitor C3 and resistor R12. As stated earlier, this time constant circuit 48 is very fast and lasts for a time period from 0.5 to 0.8 seconds. The third time constant circuit 48 starts to discharge essentially at the same time that the first time constant 32 expires, which is at time point "C" in FIG. 4, if a flame signal is not detected but is delayed to point "E", as shown in FIG. 5, if a flame signal is detected.

When time constant 32 expires, a low signal is input to the first NAND gate 36, causing a high output on line 38. This high is also coupled through diode 64 to line 66, which causes a logic low on line 65, which removes heat to the ignitor 14.

This high on line 38 is also coupled through diode 39 to line 40 to force NAND gate 42 to have a low on output line 44, which is coupled directly to inverter gate 59 to turn OFF the drive to the start winding of blower motor 16 and, through diode to the input of third NAND gate 46, to release the third time constant 48. If no flame has been detected by that time, the third time constant 48 discharges to a low voltage thus causing a logic high on the output of third NAND gate 46 on line 47 to disable the driver gate 22 and remove the power to the blower motor 16. Thus the unit is disabled. At the same time, the disabling output on line 47 from third NAND gate 46, which is a logic high signal, is coupled through lock-up circuit 49 comprised of diode D5 and resistor R13 to produce an output on line 51 that is coupled to the base of the transistor, Q1, in the photocell flame control circuit 50. This large signal turns ON transistor Q1 and essentially grounds line 54 to the diode 56 (D3). Thus, the third time constant circuit 48 cannot be charged through the transistor Q1 in the photocell flame circuit 50. The circuit is therefore effectively disabled and locked in that state. To restart, power switch 27 has to be opened, all of the circuits initialized, and the power switch 27 reclosed to commence the start process all over again.

If, at the end of the ignition trial period or during the flame test period, shown in FIGS. 4 and 5 as starting at point "C", immediately following the ignition trial period, a flame is detected by photocell 18, the signal on line 52 is coupled through capacitor C1 to the base of transistor Q1 in the photocell flame control circuit 50. Since photocell 18 produces an AC output voltage, because of the flickering or fluctuating flames, if the peak-to-peak amplitude of the output from the photocell 18 is sufficiently high, the negative going pulses will be applied through capacitor C1 to the base of Q1 thus turning it OFF. When it is turned OFF, the 12 volts DC signal on line 28 is coupled through resistor R4 to the diode 56, charges capacitor C3, which forms the third time constant circuit 48. Thus during every negative cycle of the waveform being received from the photocell 18, typically a 30 hertz dominant frequency, the transistor Q1 will be shut OFF to allow a DC voltage from a DC voltage power supply on line 28 through R4 to be used to charge capacitor C3 that, it will be recalled, is discharging rapidly. As long as the frequency period is within a sufficient range to enable the capacitor C3 to be continuously recharged faster than it is discharging during the positive going half cycle of the flame signal, the blower motor will remain ON, as shown in FIG. 5 from points 3C to 3E, during which time the motor main remains "ON".

In addition, the DC component of the flame signal from photocell 18 on line 52 is blocked by capacitor C1 so that ambient light cannot activate the circuit. However, if the flame is so low that the peak-to-peak amplitude of the signal being passed through C1 is not sufficient to overcome the bias on the base of Q1 and turn it OFF, then the capacitor C3, and the third time constant 48, will discharge and the unit will be turned OFF, Thus both-frequency and the peak-to-peak amplitude of the signal detected by the photocell and coupled on line 52 to transistor Q1 must be within a predetermined range in order for the circuit to continue to keep power to the blower motor.

It should be noted that photocell 18 can be replaced with a photo detector 17 (FIG. 1) with a transistor output and further that a fiber optic cable 52 (in FIG. 1) can be used to couple the light from the chamber 12 to the photo detector 17 such as a Motorola MFOD72.

Again, the first time constant 32 has a time constant period of approximately 6 seconds. The second time constant circuit 34 has a time constant period of approximately 3-½ seconds, and the third time constant circuit 48 has a time constant period of approximately 0.5 to 0.8 seconds. In addition, it can be seen in FIG. 2 that the output of the NAND gate 46 on line 47, when it is high and disables the blower motor circuit 22, is also coupled through the lock-up circuit 49 that includes diode D5 and resistor R13 to bias the base of transistor Q1 in the photocell flame control circuit 50 to prevent it from being turned ON by any spurious signals. Thus the circuit is locked to prevent a restart without removal of the AC voltage through switch 27.

Thus in summary, on power-up the DC power supply voltage goes from 0 to 11 volts. As soon as the CMOS logic threshold is reached, the four NAND gates 36, 42, 46, and 63 are initialized. NAND gates 36 and 63 turn ON the IGBT 21 in the ignitor drive circuit 20, which delivers half-wave DC voltage to the ignitor assembly 14.

After approximately 3-½ seconds, the ignitor preheat time, third NAND gate 46 turns ON triac 15 in the blower motor drive circuit 22 which delivers AC line voltage to the main winding of the motor 16. NAND gate 42 causes turn ON of triac 62 in the motor start drive circuit 61, which delivers 120 volts AC RMS to the start winding of the motor 16. From this point the ignitor 14 remains ON for approximately 2-½ more seconds, which is the ignition trial period, as shown in FIGS. 4 and 5 to be between points "B" and "C", prior to being turned OFF by the dissipation of the first time constant circuit 32.

When the blower motor 16 is turned ON, at point "B", it delivers air to a siphon nozzle, well known in the art, which draws fuel oil up from a supply source while at the same time the fan attached to the motor shaft forces secondary combustion air into the combustion chamber assembly. During the ignition trial period, if all systems are "go", the atomized fuel is lit by the ignitor 14 and a flame will be established in the chamber 12. The photocell 18 is positioned at the back of the chamber to monitor the flame in the chamber 12. If the photocell 18 senses an adequate amount of flame in the chamber, a multifrequency, variable amplitude flame signal is fed into the photocell flame control circuit 50 and the blower motor drive circuit 22 will remain turned ON. If for some reason an adequate flame in the chamber is not established, blower motor driver circuit 22 will be turned OFF by NAND gate 46 within one second after the ignition trial period has expired by reason of the third time constant 48. After a "normal shutdown" due to an out-of-fuel condition, for example, the control goes into a lock-up mode for safety considerations by the signal through lock-out circuit 49 at which time the blower motor cannot be turned ON unless power is removed and then reapplied through switch 27.

Figure 6:
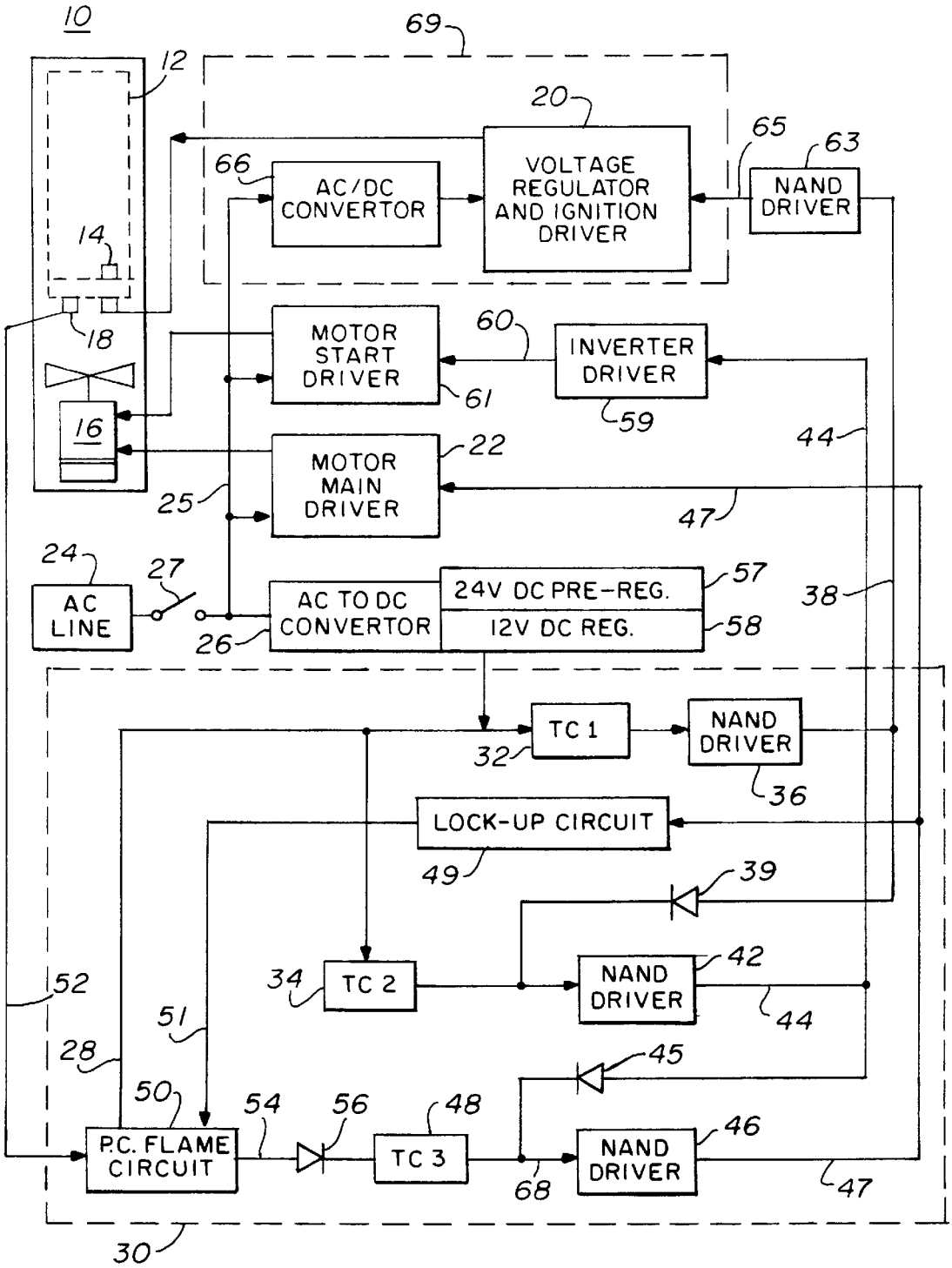
FIG. 6 is a corresponding block diagram of the second embodiment of the present invention.
Figure 7:
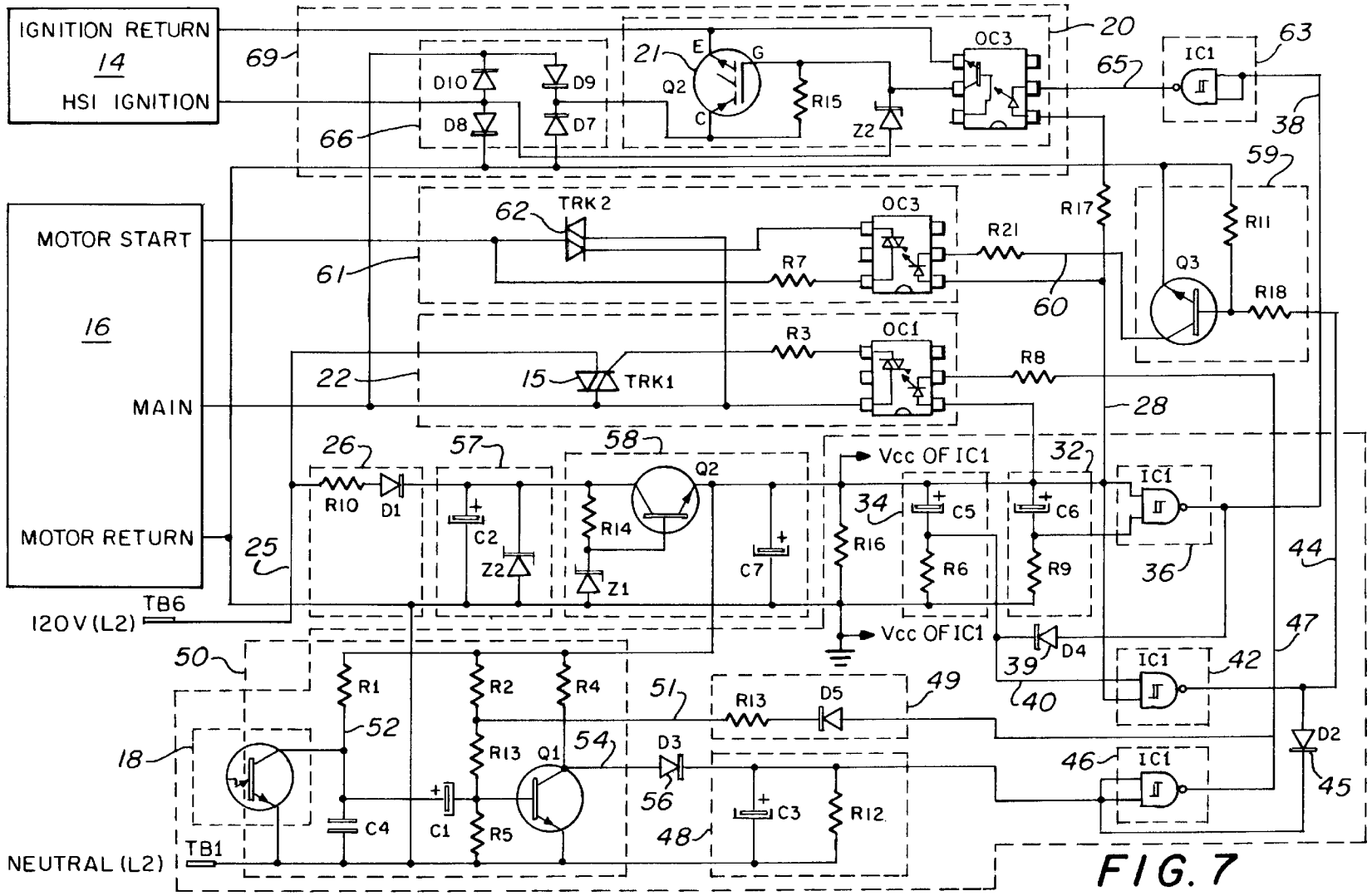
FIG. 7 is a corresponding circuit diagram of the second embodiment of the present invention.

The second embodiment shown in FIG. 6 and FIG. 7 is similar to the first embodiment except that ignitor power regulator circuit 69 includes an ignitor driver 20 having a voltage regulator 21 that is coupled to the hot surface ignitor 14 to selectively couple AC line voltage from source 24 on line 25 through a first AC/DC converter 66 to the ignitor 14.

The output of the first time constant circuit 32 is coupled to NAND gate driver 36 whose output on line 38 is a logic low that is coupled to the input of NAND gate 63, which generates a logic high output on line 65, turns OFF the optical isolator in driver 20 and enables IGBT voltage regulator and ignition driver 20. Driver 20 provides a predetermined full-wave pulsating DC voltage output from the first AC/DC converter 66 to the hot surface ignitor 14 to begin to heat it.

Also, the voltage ignitor/voltage regulator circuit 20 provides consistent ignitor or output temperatures to ensure ignition even at extremely low temperatures over a wide range of AC line voltages.

As soon as the CMOS logic threshold is reached, the first time constant circuit 32 and the second time constant circuit 34 begin to charge. The junction of capacitor C6 and resistor R9 in the first time constant circuit 32 as shown in FIG. 7 is coupled as an input to NAND gate driver 36. This causes the output on line 38 to go essentially to ground potential. This ground potential on line 38 is coupled to both inputs of NAND gate 63 which generates a logic high output and turns OFF the output of optical circuit OC3 in driver circuit 20 which, in turn, removes the base to emitter short of transistor 21 to allow the ignition driver IGBT 21 to be biased ON by resistor R15. Also the line voltage dips when the blower motor 16 is energized and blows air over the ignitor, which tends to cool it down some. The first voltage regulator circuit (zener diode, Z2, in driver circuit 20) will keep the ignitor voltage at a constant predetermined voltage (around 75% of normal line voltage) thus helping to maintain a constant temperature output from the ignitor 14. As described above, AC voltage on line 25 through a full-wave bridge rectifier circuit 66 is applied to the ignitor 14 and begins the preheat stage of operation at time point "A" in FIGS. 4 and 5.

At the same time that the high output from the second NAND gate 42 on line 44 is energizing gate 59 and, through diode 45 is energizing the third NAND gate 46 to start the fan blower motor, it is also charging third time constant 48 containing parallel capacitor C3 and resistor R12. As stated earlier, this time constant circuit 48 is very fast and lasts for a time period from 0.5 to 0.8 seconds. The third time constant circuit 48 starts to discharge essentially at the same time that the first time constant 32 expires, which is at time point "C" in FIG. 4, if a flame signal is not detected but is delayed to point "E", as shown in FIG. 5, if a flame signal is detected.

When time constant 32 expires, a low signal is input to the first NAND gate 36, causing a high output on line 38. This high is also coupled through to NAND gate 63 that causes a logic low on line 65 that turns ON the output transistor OC2 to remove the bias from IGBT Q1 and removes drive to the ignitor 14.

However, if the flame is so low that the peak-to-peak amplitude of the signal being passed through C1 is not sufficient to overcome the bias on the base of Q1 and turn it OFF, then capacitor C3 and the third time constant 48 will discharge and the unit will be turned OFF. Again, both frequency and the peak-to-peak amplitude of the signal detected by the photocell and coupled on line 52 to transistor Q1 must be within a predetermined range in order for the circuit to continue to keep power to the blower motor.

Thus, in summary, on power-up of the second embodiment, the DC power supply voltage goes from 0 to 11 volts. As soon as the CMOS logic threshold is reached, the four NAND gates 36, 42, 46, and 63 are initialized. NAND gates 36 and 63 turn ON the IGBT 21 in the ignitor drive circuit 20, which delivers full-wave rectified AC line voltage to the ignitor assembly 14.

Figure 8:
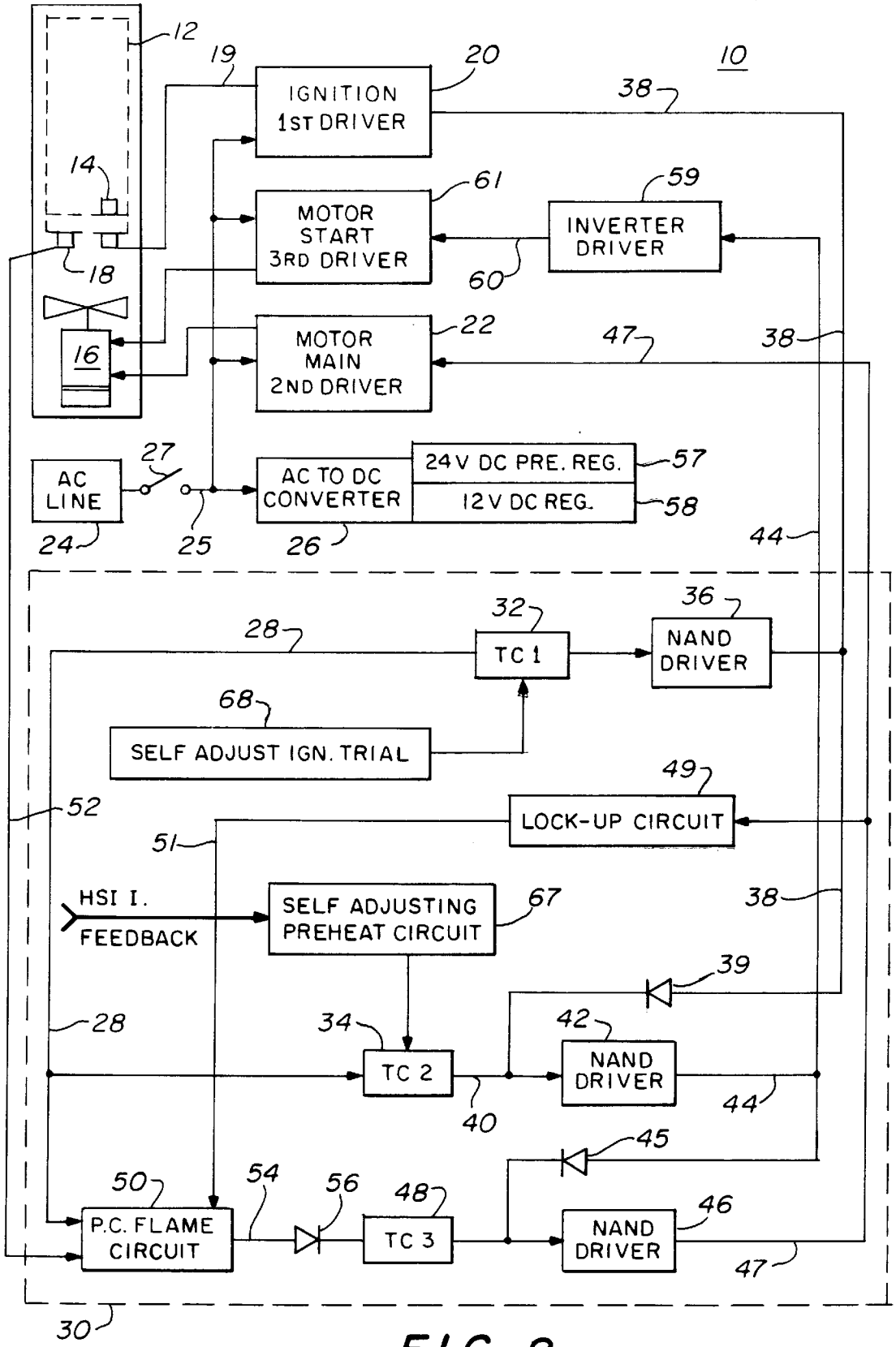
FIG. 8 is a schematic block diagram of the third embodiment of the present invention.
Figure 9:
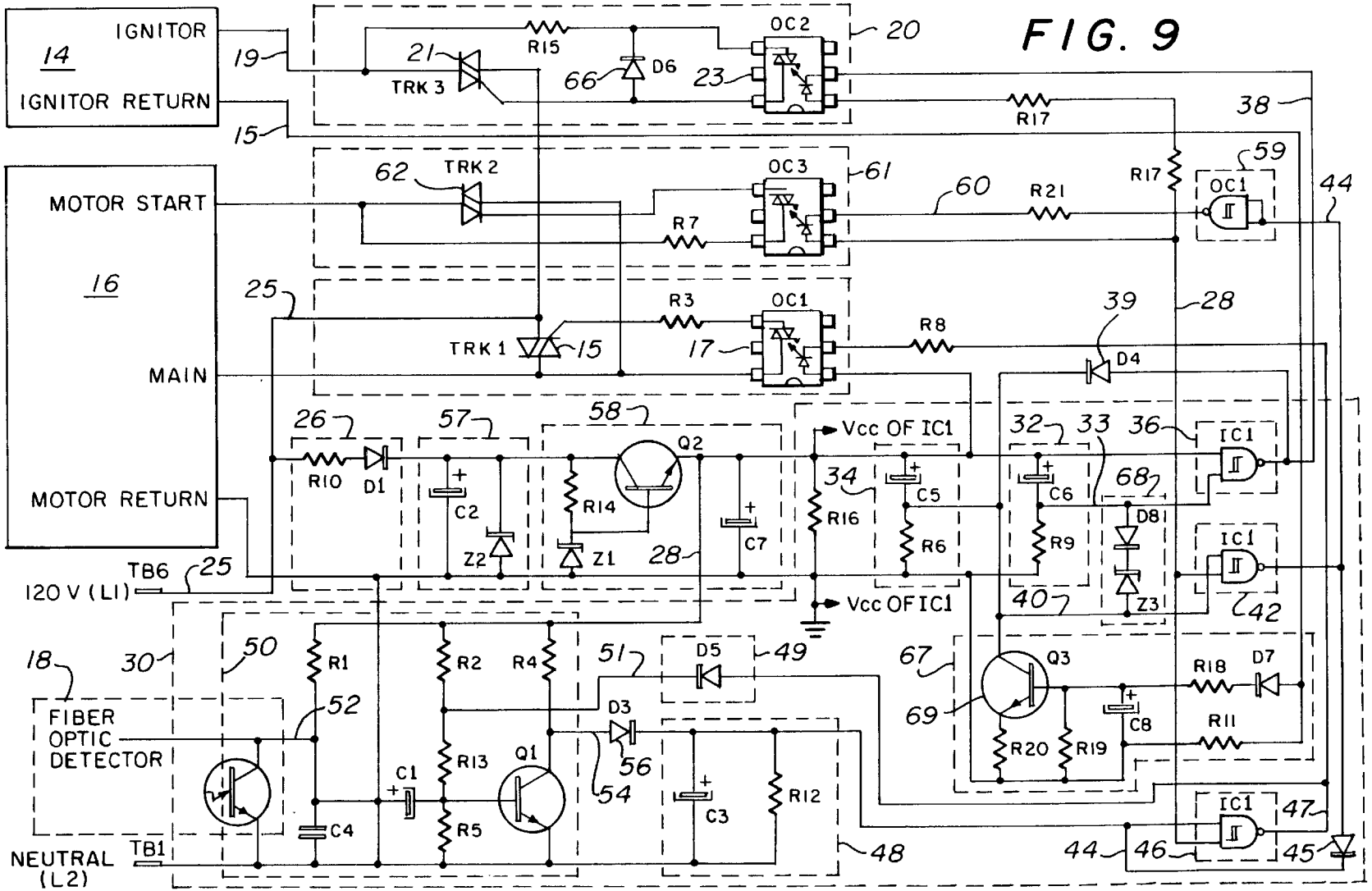
FIG. 9 is a corresponding circuit diagram of the third embodiment of the present invention.

The third embodiment shown in FIG. 8 and FIG. 9 is essentially as the first and second embodiments with certain additions and changes. FIG. 8 is a schematic block diagram of the third embodiment of the novel fuel oil-type burner 10 illustrating the combustion chamber in phantom lines in which is positioned a hot surface ignitor 14. Blower motor 16 not only provides the air for the combustion chamber 12, but, as stated previously, also-provides the fuel oil to the combustion chamber in a well-known manner. An ignitor driver 20 forms a first switch that is coupled to the hot surface ignitor 14 to selectively couple half-wave or full-wave rectified AC line voltage from source 24 on line 25 through triac 3 (FIG. 9) to the ignitor 14. As can be seen in FIG. 9, triac 3 is biased ON during the positive half cycle by diode 66 continuously during normal operations and is biased ON during the negative half cycle by optical isolator 23 (OC2) to provide full-wave DC voltage during STARTUP. Thus, the ignitor 14 is maintained at half power during normal RUN operations to reduce carbon buildup on the ignitor electrode and has full power applied thereto during start operations. In like manner, motor driver switches 22 and 61 (FIG. 8 and FIG. 9) form second and third switches, respectively, that selectively couple the alternating current voltage on line 25 to the blower motor 16 to provide the fuel and air to the combustion chamber 12.

When switch 27 in FIG. 8 is closed and the voltage from source 24 on line 25 is applied to the AC/DC converter 26, which supplies DC voltage to the preregalator 57, the preregulator 57 limits the voltage at the input of the voltage regulator 58 to 24 volts as previously discussed in relation to the other embodiments.

Time constant circuit, TC1, represented by block 32 in FIG. 8, has a time period that lasts for approximately 6 seconds. This time period is shown in FIGS. 4 and 5 to be from 1A to 1C and is labeled "TC1". The first 3 seconds of TC1 is a preheat period in which the ignitor 14 is brought to the proper temperature. This time period is shown in FIGS. 4 and 5 to be from 2A to 2B and is labeled "TC2". Note that TC2 may be shortened by the self-adjusting preheat circuit 67, as determined by the amount of ignitor current that causes transistor 69 to conduct. At the same time, the first time constant circuit 32 (TC1) begins to function and the second time constant circuit, TC2, represented by block 34, also begins to function, Its time constant period is approximately 3 seconds and is coupled on line 40 to NAND gate 42. Note that time constant TC1 is also reduced by circuit 68, if TC2 is first shortened by circuit 67, because circuit 68 coupled the outputs 33 and 40 of the two time constant circuits together. This causes no output on line 44, which includes a diode 45 that is coupled to the input of NAND driver 46 and a third time constant circuit, TC3, represented by block 48. The remainder of the circuit operates as previously described.

Thus the advantages obtained over the prior art by using the circuit of FIG. 8 and FIG. 9 as described, in addition to those previously discussed, includes a circuit such that the first time constant circuit preheats the hot surface ignitor 14 and the ignitor current is sampled by circuit 67 through ignitor return line 15 to shorten TC2, if the current is high enough to cause a fast preheat such as would be accounted at high line voltages and with low resistance ignitors. The remainder of the circuit operates as previously described.

FIG. 9 discloses the details of the block diagram of FIG. 8 and is a complete circuit diagram of the third embodiment of the present invention. When the switch 27 (FIG. 8) is closed and the voltage from AC source 24 (FIG. 8) is applied to the AC/DC converter 26, DC voltage is supplied to the preregulator 57 and charges capacitor C2. The circuit then operates as previously described to couple the AC line voltage to the ignitor 14 and begins the preheat stage of operation at point "A" in FIGS. 4 and 5.

At the same time that the high output from the second NAND gate 42 on line 44 through diode 45 is energizing the third gate 46 and inverter gate 59 to start the fan blower motor, it is also charging third time constant circuit 48 containing parallel capacitor C3 and resistor R12. As stated earlier, this time constant circuit 48 is very fast and lasts for a time period from 0.5 to 0.8 seconds. The third time constant circuit 48 starts to discharge essentially at the same time that the first time constant 32 expires, which is at time point "C" in FIGS. 4 and 5, if a flame signal is detected, but is lost at point "E", as shown in FIG. 5, then shutdown occurs at point "F".

When time constant 32 expires, a low signal is input to the first NAND gate 36, causing a high output on line 38, which turns OFF the negative going half-cycle of power to the ignitor to reduce the power to the ignitor 14. The ignitor continues to operate at half-wave and at half-power due to diode 66 driving triac 21. Otherwise, the ignition trial period and the flame test period operate as discussed previously in relation to the first and second embodiments.

As indicated earlier, the first time constant 32 has a time constant period of approximately 5 seconds. TC1 may be shortened by the self-adjusting preheat and ignition trial circuits 67 and 68, as determined by the amount of ignitor current. The second time constant circuit 34 has a time constant period of approximately 3 seconds, but may be shortened by circuit 67, and the third time constant circuit 48 has a time constant period of approximately 0.5 to 0.8 seconds as discussed previously. The circuit otherwise operates as earlier discussed.

In summary, the third embodiment operates essentially as the first and second embodiments except that the ignitor 14 is maintained at half power during normal RUN operations to reduce carbon buildup on the ignitor electrode and has full power applied thereto during start operations. Also, it has a very simple electronic circuit that has a self-adjusting ignitor preheat time period, a self-adjusting ignition trial period, and a subsequent flame test period in which, if no flame is apparent, the system shuts down as indicated previously.

The corresponding structures, materials, acts, and equivalents of all means or step plus function elements in the claims below are intended to include any structure, material, or act for performing the function in combination with other claimed elements as specifically claimed.

What is claimed is:

1. A fuel oil-type burner including:

a fuel oil combustion chamber;

a power source for providing an AC voltage;

a hot surface ignitor electrode associated with said combustion chamber, said ignitor electrode being sintered to full density with essentially no porosity;

a fan blower driven by a split-phase type of motor and having both a main and start winding for providing fuel oil and air to said combustion chamber;

an AC/DC converter coupled to said AC voltage for providing a DC voltage output;

a voltage regulator circuit to provide a regulated low voltage DC voltage output;

a first controllable switch coupled between said AC voltage and said hot surface ignitor;

a second controllable switch coupled between said AC voltage and said fan blower motor main winding;

a third controllable switch coupled between said AC voltage and said fan blower motor auxiliary start winding;

a flame detector associated with said combustion chamber for generating an electrical signal if a flame is detected; and a control assembly coupled to said series voltage regulator circuit, said flame detector, and said first, second, and third controllable switches for:

energizing said first controllable switch to heat said hot surface ignitor with DC voltage from said AC voltage for a predetermined preheat time period;

energizing said second and third controllable switches to operate said blower motor with said AC voltage during a predetermined trial ignition time period;

de-energizing the third controllable switch immediately following said trial ignition time period to de-energize the start winding of said blower motor;

causing said motor to continue to run during a time period of approximately one second, known as the "flame test time period"; and turning the second controllable switch OFF to shut down the heater if no ignition occurs during said flame test time period.

2. A fuel oil burner as in claim 1 wherein said control assembly includes:

a first time constant circuit for generating a first signal to said first controllable switch for coupling said rectified DC voltage to said hot surface ignitor to preheat said ignitor for said predetermined preheat time period and to cause said ignitor to maintain said preheat condition for the predetermined trial ignition time period;

a second time constant circuit for generating a second signal to said second and third controllable switches to couple said AC voltage to said blower motor main and start windings beginning with said predetermined trial ignition time period; and a third time constant circuit for causing said fan blower motor to operate only if a flame is detected and to de-energize said fan blower motor if said flame is not detected within said predetermined flame test time period.

3. A fuel oil burner as in claim 2 wherein said control assembly further includes:

a first drive circuit coupled to said first controllable switch;

said first time constant circuit being coupled to said first drive circuit for generating said first signal to cause said ignitor to preheat for said predetermined preheat time period and to continue heating for said predetermined trial ignition time period;

a second drive circuit coupled to said blower motor main winding;

a third drive circuit coupled to said blower motor start winding;

said second time constant circuit being coupled to said second and third drive circuits for energizing said blower motor and providing said fuel oil and air at the beginning of said predetermined trial ignition time period; and said third time constant circuit being coupled between said flame detector and said second drive circuit for maintaining said blower in said energized state if said flame is detected by said flame detector no later than the expiration of said flame test time period.

4. A fuel oil burner as in claim 3 wherein said control assembly further includes a circuit which permits restart after power down, even if there is a flame in the combustion chamber, to allow safe burning of excess fuel that may have collected in the chamber due to previously unsuccessful ignition tries.

5. A fuel oil burner as in claim 4 wherein said control assembly further includes a circuit that provides shorted flame detector protection during normal operation of the burner.

6. A fuel oil burner as in claim 5 wherein said voltage regulator circuit further includes a voltage phase regulator for providing constant power to the ignitor.

7. A fuel oil burner as in claim 6 wherein the voltage phase regulator is a half-wave voltage phase regulator.

8. A fuel oil burner as in claim 1 further including a current and voltage dependent ignitor power regulator circuit coupled to the power source for averaging the duty cycle of the voltage supplied to the hot surface ignitor.

9. A fuel oil burner as in claim 8 further including:

a second AC/DC converter for changing said AC power source to pulsating DC voltage for powering said hot surface ignitor; and said current and voltage dependent ignitor power regulator circuit being coupled between said second AC/DC converter and said hot surface ignitor.

10. A fuel oil-type burner as in claim 1 wherein said control assembly further includes:

an AC line voltage controller coupled to said power source for controlling the AC line voltage being applied to the ignitor, the blower motor main, and auxiliary start windings thereby eliminating the need for a separate motor start relay or posistor for starting split-phase motors; and a preregulator circuit coupled between the AC/DC converter and the voltage regulator circuit to provide output voltage during the negative going half cycle of the said AC voltage to improve current capacity and low voltage operation;

said low voltage regulator circuit being used along with the preregulator circuit to minimize voltage variations of the output of the low voltage regulator so as to result in more consistent control timing for each of the time periods.

11. A fuel oil burner as in claim 1 wherein said control assembly includes:

a first time constant circuit for generating a first signal to said first controllable switch and said AC/DC converter to couple said pulsating DC voltage to said hot surface ignitor to preheat said ignitor for said predetermined preheat time period and to cause the ignitor to maintain said preheat condition for the predetermined trial ignition period of time;

a second time constant circuit for generating a second signal to said second and third controllable switches to couple said AC voltage to said blower motor main and start windings beginning with said predetermined trial ignition period of time; and a third time constant circuit for causing said fan blower motor to continue to operate only if a flame is detected and to de-energize said blower motor if said flame is not detected within said predetermined flame test time period.

12. A fuel oil burner as in claim 11 wherein said fuel oil-type burner further includes:

a rectifier circuit to provide full-wave pulsating DC circuit; and an analog voltage regulator coupled to said full-wave pulsating DC rectifier circuit for providing constant voltage to the ignitor.

13. A fuel oil burner as in claim 12 wherein said analog voltage regulator is a series-type regulator with a zener reference diode.

14. A fuel oil burner as in claim 1 wherein said control assembly includes:

a first time constant circuit for generating a first signal to said first controllable switch for coupling said AC voltage to said hot surface ignitor to preheat said ignitor for said predetermined preheat period of time and to cause said ignitor to maintain said preheat condition for said predetermined trial ignition period of time;

a second time constant circuit for generating a second signal to said second and third controllable switches to couple said AC voltage to said blower motor main and start windings beginning with said predetermined trial ignition period of time;

a circuit coupled between said first and second time constant circuits for reducing said second and first said time constants, in that order, depending upon the ignitor current;

a third time constant circuit associated with said second time constant circuit for causing said fan blower motor to continue to operate if a flame is detected and to de-energize said fan blower motor if said flame is not detected within said predetermined flame test time period; and a control circuit in said first controllable switch for maintaining said ignitor at half-wave power level during said predetermined "flame test" time period.

15. A fuel oil burner as in claim 1 wherein said control assembly includes:

a first time constant circuit for determining the total time period for which full power is supplied to said first controllable switch for coupling said AC voltage to said hot surface ignitor;

a second time constant circuit for determining said preheat time period and supplying a signal to said second and third controllable switches to couple said AC voltage to said blower motor main and start windings only during said predetermined trial ignition time period;

a third time constant associated with said second time constant circuit for supplying a signal to said second controllable switch for causing said fan blower motor to continue to operate if a flame is detected, and to de-energize said fan blower motor if said flame is not detected within said predetermined flame test time period;

a current-sensing circuit for sensing the current of said ignitor; and a transistor coupled to said second time constant circuit and said current-sensing circuit so as to decrease said second time constant and reduce the preheat time period and turn the blower motor ON to prevent ignitor over-temperature as said ignitor current increases.

16. A fuel oil burner as in claim 1 wherein said control assembly includes:

a first time constant circuit for determining the total time period for which the AC voltage source is applied to said first controllable switch for coupling said AC voltage to said hot surface ignitor;

a second time constant circuit for determining said preheat time period and supplying a signal, starting at the end of said second time constant, to said second and third controllable switches to couple said AC voltage to said blower motor main and start windings only during said trial ignition time period;

a current-sensing circuit for sensing the current of said ignitor;

a transistor coupled to said second time constant circuit and said current-sensing circuit so as to shorten said second time constant to reduce the preheat time period and turn the blower motor ON to prevent ignitor over-temperature as said ignitor current increases; and a drive circuit coupled to said first time constant circuit and that is activated by said current-sensing circuit to reduce the total ignition ON time including the trial ignition time period.

17. A fuel oil burner as in claim 1 wherein said control assembly further includes:

a first drive circuit coupled to said first controllable switch;

said first time constant circuit being coupled to said first drive circuit for generating said first signal to cause said ignitor to preheat for said predetermined preheat time period and to continue heating for said predetermined trial ignition time period;

a second drive circuit coupled to said blower motor main winding;

said second time constant circuit being coupled to said second drive circuit for energizing said blower motor main winding;

a third drive circuit coupled to said blower motor start winding;

said second time constant circuit being coupled to said second and third drive circuits for energizing said blower motor main and start windings and providing said fuel oil and air at the beginning of said trial ignition time period;

said third time constant circuit being coupled between said flame detector and said second drive circuit for maintaining said blower in said energized state if said flame is detected no later than the expiration of said flame test time period; and said third time constant circuit permitting restart after power-down even if there is a flame in the combustion chamber, to allow safe burning of excess fuel that might collect in the chamber due to previously unsuccessful ignition tries.

18. A fuel oil burner as in claim 1 wherein said AC power supply provides at least 100 volts AC RMS.

19. A fuel oil burner as in claim 1 wherein said AC power supply further includes:

a first drive circuit coupled to said first controllable switch;

said first drive circuit preventing carbon buildup on said ignitor electrode by heating said ignitor continuously with full-wave rectified DC voltage during STARTUP sufficiently to evaporate or burn off any fuel that might collect on said ignitor electrode during operations, including diesel fuel;

a control circuit coupled to said first controllable switch for activating said first controllable switch and intermittently providing half-wave voltage to said ignitor electrode to prevent carbon buildup on said ignitor electrode during a normal RUN; and an optical circuit in said first controllable switch for causing either said intermittent or said continuous heating of said ignitor electrode to prevent carbon buildup on the said ignitor electrode.

* * * * *

UNITED STATES PATENT AND TRADEMARK OFFICE

CERTIFICATE OF CORRECTION

PATENT NO. : 6,099,295
DATED : August 8, 2000
INVENTOR(S) : Hugh, W. McCoy; Gregory L. Sibalich It is certified that error appears in the above-identified patent and that said Letters Patent is hereby corrected as shown below:

Column 1,
Line 24, delete "firer" and substitute therefor -- further --.
Line 56, delete "educator" and substitute therefor -- eductor --.
Line 59, delete "educators" and substitute therefor -- eductors --.

Column 2,
Line 2, delete "educators" and substitute therefor -- eductors --.
Line 9, add a period after combustion.

Column 5,
Line 57, delete "tines" and substitute therefor -- times --.

Column 7,
Line 44, delete "tidings" and substitute therefor -- timings --.

Column 9,
Line 11, delete "ta" and substitute therefor -- to --.
Line 55, delete "voltage-being" and substitute therefor -- voltage being --.

UNITED STATES PATENT AND TRADEMARK OFFICE

CERTIFICATE OF CORRECTION

PATENT NO. : 6,099,295
DATED : August 8, 2000
INVENTOR(S) : Hugh, W. McCoy; Gregory L. Sibalich It is certified that error appears in the above-identified patent and that said Letters Patent is hereby corrected as shown below:

Column 10,
Line 7, delete "things" and substitute therefor -- timings --.

Column 11,
Line 31, delete "AND" and substitute therefor -- NAND --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*